US005300000A

United States Patent [19]

Schwartz

[11] Patent Number: 5,300,000

[45] Date of Patent: Apr. 5, 1994

[54] EXERCISE SLEEVE

[76] Inventor: Leonard Schwartz, 5526 Northumberland St., Pittsburgh, Pa. 15217

[21] Appl. No.: 763,981

[22] Filed: Sep. 23, 1991

[51] Int. Cl.[5] ..... A63B 21/065

[52] U.S. Cl. ..... 482/105

[58] Field of Search ..... 482/105

[56] References Cited

U.S. PATENT DOCUMENTS

| | | | |
|---|---|---|---|
| 3,490,766 | 1/1970 | Gardner | 482/105 |
| 4,034,979 | 7/1977 | Wester | 482/105 X |
| 4,247,101 | 1/1981 | Gallmeyer | 482/105 X |
| 4,293,126 | 10/1981 | Havens | 482/105 X |
| 4,303,239 | 12/1981 | Walsh, Jr. | 482/105 |
| 4,330,120 | 5/1982 | Netti | 482/105 |
| 4,369,967 | 1/1983 | Kimura | 482/105 |
| 4,384,714 | 5/1983 | Kimura | 482/105 |
| 4,556,215 | 12/1985 | Tarbox et al. | 482/105 |
| 4,575,075 | 3/1986 | Tarbox et al. | 482/105 |
| 4,621,808 | 11/1986 | Orchard et al. | 482/105 |
| 4,623,143 | 11/1986 | Wuellenweber | 482/105 |
| 4,684,123 | 8/1987 | Fabry | 482/105 |
| 4,709,921 | 12/1987 | Valoikas et al. | 482/105 |
| 4,846,464 | 7/1989 | Torno | 482/105 |
| 4,989,267 | 2/1991 | Watson | 482/105 X |
| 5,004,227 | 4/1991 | Hoffman | 482/105 |

FOREIGN PATENT DOCUMENTS

| | | | |
|---|---|---|---|
| 881068 | 9/1971 | Canada | 482/105 |
| 8301201 | 4/1983 | PCT Int'l Appl. | 482/105 |

*Primary Examiner*—Robert Bahr

*Attorney, Agent, or Firm*—Ansel M. Schwartz

[57] ABSTRACT

An exercise sleeve that fits on a hand comprising a weighted layer that removably conforms with the hand in a continuous manner across the palm and the back of the hand and which fits about the thumb. The exercise sleeve is also comprised of a skin in which the weighted layer is disposed and which adjustably and removably conforms with the hand. The skin has a hole through which the thumb extends when the skin is on the hand. In a preferred embodiment, the skin has device for adjustably and removably fastening the skin to the hand. The exercise sleeve is fitted on the hand of a user and, with the fastening device, fittingly secured on the hand so that it is comfortable. When the user moves his hand during exercise, the additional weight provided by the weighted layer of the sleeve enables the user to accomplish various desired exercises for the benefit of his physiology.

14 Claims, 3 Drawing Sheets

EXERCISE SLEEVE

FIELD OF THE INVENTION

The present invention is related to an exercise apparatus. More specifically, the present invention is related to an exercise sleeve that is weighted and fits on the hand.

BACKGROUND OF THE INVENTION

Handweights have been accepted exercise equipment for centuries. Recent research has given more explicit documentation for the multiple benefits of exercise that makes use of handweights.

A major advance in the understanding of handweight exercise and in the prescription thereof came concurrently with the invention of the strapped handweight (see U.S. Pat. Nos. 4,351,526 and 4,627,618). This technique and hardware enhanced the benefits that could be derived from handweight exercise. Specifically, this invention implemented forms of activity which utilized large percentages of skeletal muscle simultaneously. A more complete discussion of these factors is presented in three books: *Heavyhands: the Ultimate Exercise; Heavyhands Walking; and the Heavyhands Walking Book*!, by Leonard Schwartz, M.D., published in 1982, 1987 and 1989, respectively.

Users of conventional handweights have all suffered certain disadvantages during their use. (1) The unstrapped versions (see above) require the host to grip the weight with excessive force with consequent discomfort, early fatigue, and often undue elevations of the arterial blood pressure. (2) The extension outward of the weighted ends from the shaft of the weight may make for excessive discomfort and even precipitate injuries of muscles and joints of the upper extremities. In addition, the lateral extensions of handweights may function as dangerous projectiles that endanger the host during highly vigorous movements.

It is clear that a handweight constructed in the configuration of a glove or sleeve would negate these objections by virtually eliminating the need for gripping and by eliminating lateral extensions of the weight which are biomechanical disadvantages to the user and which may reduce the overall safety of such exercise.

Handweighted gloves have been tried before. See U.S. Pat. No. 4,247,097 of Dr. Leonard Schwartz. Prior inventions suffer either from severe limitation in the amount of weight that can be included in the weight itself, or from the inherent structure of the weight which results in unfortunate movements within the glove itself during exercise. Most current weighted glove inventions suffer both these disadvantages.

The present invention corrects these problems by increasing the weight (resistance) that can be placed within a glovelike embodiment that is inherently stable during use and virtually negates the likelihood of trauma. Thus, this invention creates a handweight with the greatest potential for freedom of movement by combining maximal resistance (weight) with the greatest possible range of motion while eliminating user concern over trauma. Stated otherwise, the ultimate effect of this invention is to maximize the energy cost of exercise per pound of handweight with the least amount of discomfort.

Finally, the present embodiment makes for more effective and comfortable exercise by promoting the feeling in the user that the weight is an extension of the hand itself, rather than a heavy foreign body. This quality is inherent in the design, which in turn is contingent upon the novel construction of both the internal and surface aspects of the sleeve itself.

SUMMARY OF THE INVENTION

The present invention pertains to an exercise sleeve that fits on a hand. The exercise sleeve comprises a weighted layer that removably conforms with the hand in a continuous manner across the palm and the back of the hand and which fits about the thumb. The exercise sleeve is also comprised of a skin in which the weighted layer is disposed and which adjustably and removably conforms with the hand. The skin has a hole through which the thumb extends when the skin is on the hand. In a preferred embodiment, the skin has means for adjustably and removably fastening the skin to the hand.

The exercise sleeve is fitted on the hand of a user and, with the fastening means, fittingly secured on the hand so that it is comfortable. When the user moves his hand during exercise, the additional weight provided by the weighted layer of the sleeve enables the user to accomplish various desired exercises for the benefit of his physiology.

BRIEF DESCRIPTION OF THE DRAWINGS

In the accompanying drawings, the preferred embodiment of the invention and preferred methods of practicing the invention are illustrated in which.

DESCRIPTION OF THE PREFERRED EMBODIMENT

Figure 1:
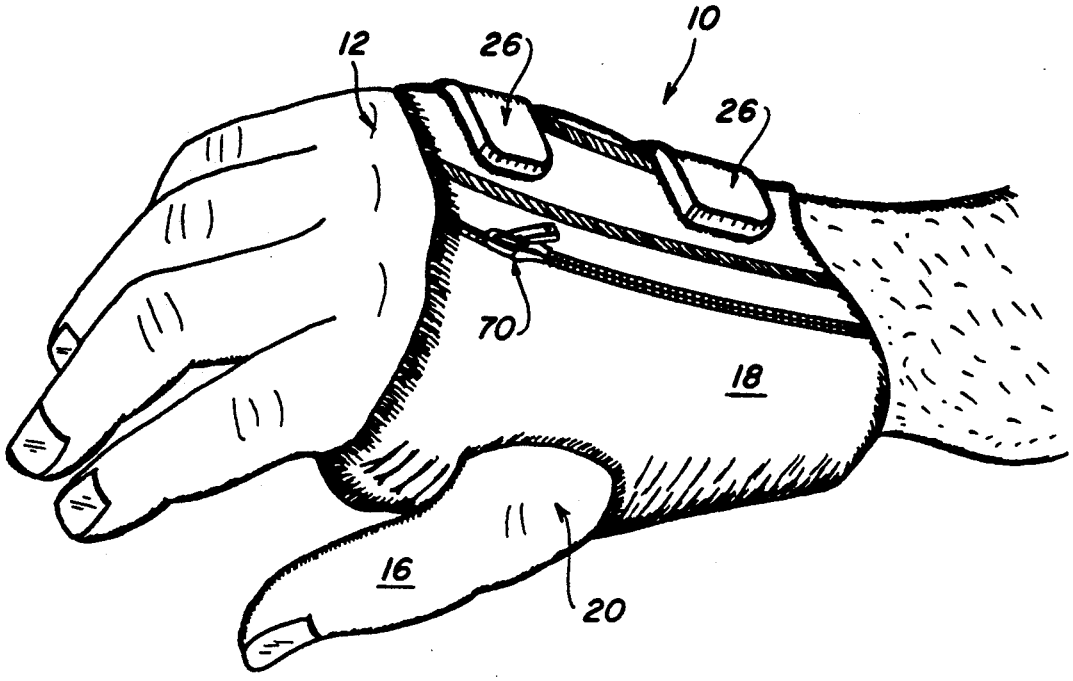
FIG. 1 is a perspective view of an exercise sleeve on a hand.
Figure 6:
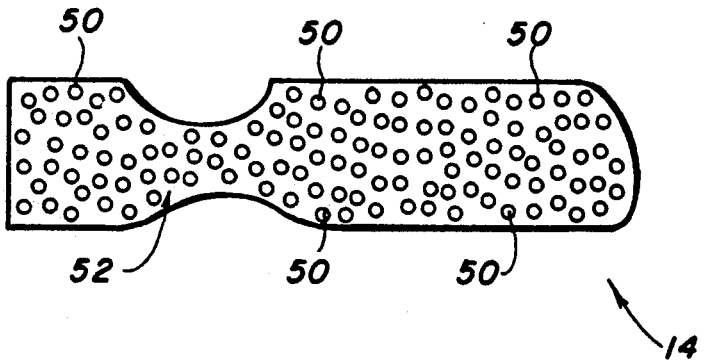
FIG. 6 is a schematic representation of an embodiment of a weighted layer for an exercise sleeve.
Figure 2:
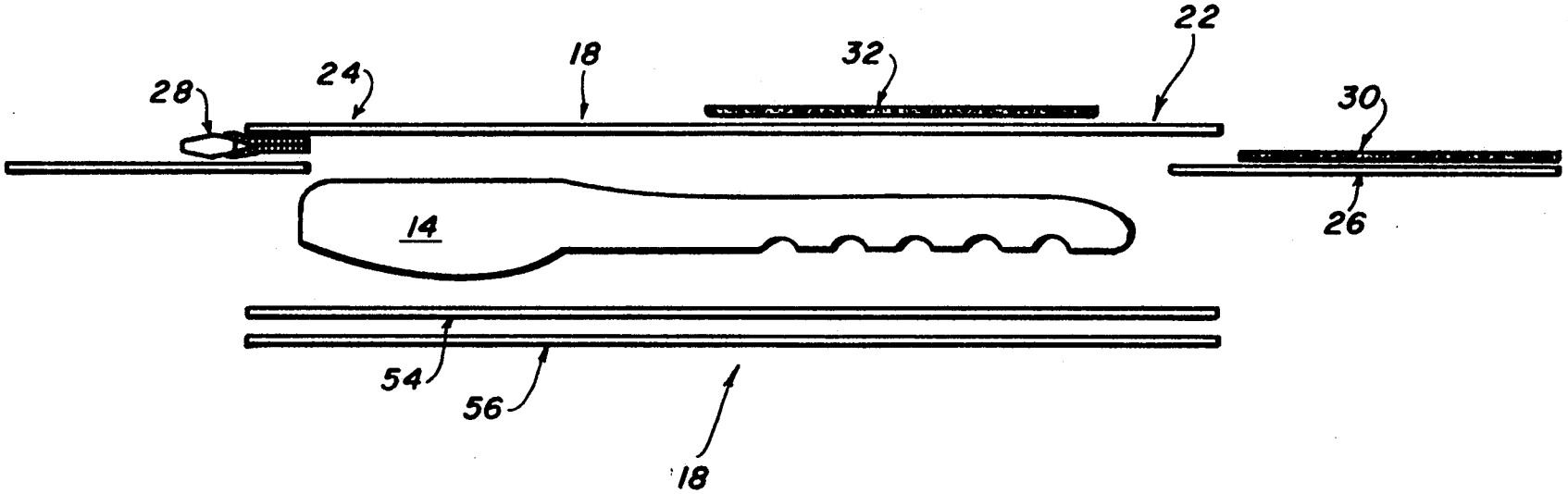
FIG. 2 is a schematic cross-sectional view of an exercise sleeve.

Referring now to the drawings wherein like reference numerals refer to similar or identical parts throughout the several views, and more specifically to FIG. 1 thereof, there is shown an exercise sleeve 10 that fits on a hand 12. The exercise sleeve 10 is, as shown in FIG. 2 which is a cross-sectional exploded view of the sleeve 10, comprised of a weighted layer 14 that conforms with the hand 12 in a continuous manner across the palm and the back of the hand 12 and which fits about the thumb 16. The exercise sleeve 10 is also comprised of a skin 18 disposed about the weighted layer 14 in which adjustably and removably conforms with the hand 12. The skin 18 has a hole 20 through which the thumb 16 extends when the skin 18 is on the hand 12.

The skin 18 has means for adjustably and removably fastening the skin 18 to the hand 12. Preferably, the skin 18 has a first side 22 and a second side 24. The fastening means preferably includes at least one strap 26, and preferably two, extending from the first side 22 and at least one loop 28, and preferably two, extending from the second side 24. The second side 24 opposes the first side 22 when the skin 18 is on the hand 12 such that the strap 26 can be inserted through the loop 28 and pulled to adjust the fit of the skin 18 on the hand 12. Preferably, the strap 26 has a first Velcro ® portion 30, and the skin 18 has a second Velcro ® portion 32 disposed in proximity to the first side 22 such that the first velcro portion 30 can mate with the second velcro portion 32 and hold the strap 26 when the strap 26 is inserted through the loop 28. Preferably, the skin 18 comprises a pile layer 54 or any other breathable and conformable material and a Coolmax ® or Spandex ® layer 56. Preferably, the skin 18 can be removed from the weighted layer 16. A zipper 70, as shown in FIG. 1, can be used to releasably connect skin 18 together around the weighted layer 16. In this manner, the skin 18 can be unzipped, and removed from the weighted layer 16 for cleaning. Alternatively, a different skin 18 can be used which has differing properties, such as color or texture.

Figure 3:
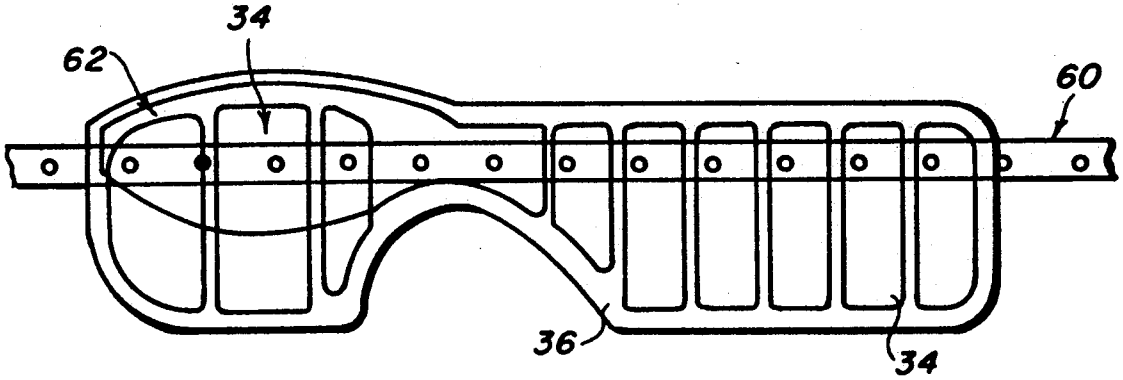
FIG. 3 is a schematic overhead cross-sectional view of an exercise sleeve for a right hand.
Figure 4:
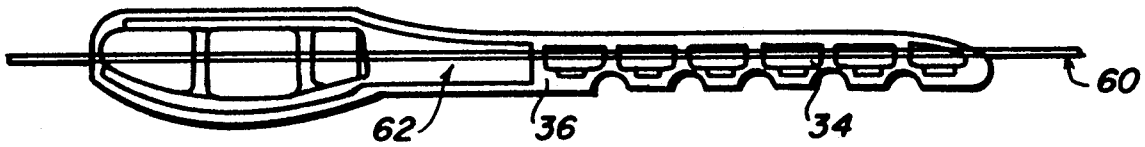
FIG. 4 is a schematic side cross-sectional view of the exercise sleeve.
Figure 5:
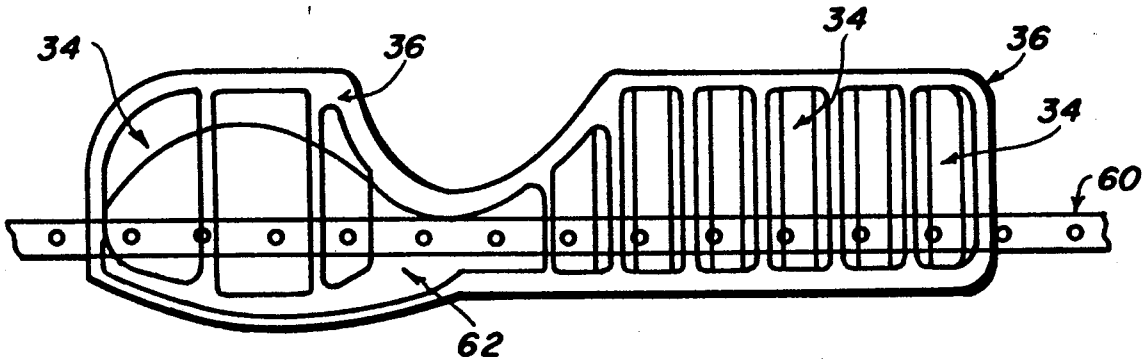
FIG. 5 is a schematic overhead cross-sectional view of the exercise sleeve.

The weighted layer 14 is preferably comprised of localized volumes of weight 34 that are disposed and fixed in a mold 36 made of a flexible but rigid material, as shown in FIGS. 3, 4 and 5. FIG. 3 is an overhead schematic representation of the weighted layer 14 for a right hand 12; FIG. 4 is a side view of the weighted layer 14 and FIG. 5 is an overhead view of a schematic representation of a weighted layer 14 for a left hand 12. Preferably, the volumes of weight 34 are connected together with strip stock 60 and are made of lead. The mold 36 material is preferably an elastomer, such as vinyl.

The volumes of weight 34 are cast from molten lead into the desired shapes, which are then dipped into a vinyl bath. When the volumes of weight 34 are dipped into the vinyl bath, the vinyl solidifies on the volumes of weight 34 which are at a lower temperature than the bath. Depending on how thick the mold in which the volumes of weight are disposed is desired, is determined by how long the volumes of weight are placed in the vinyl bath. Preferably, there is a foam insert 62 attached to the volumes of weight 34 prior to dipping for cushioning of the hand.

In an alternative embodiment and as shown in FIG. 51 the weighted layer 14 is comprised of lead shot 50 disposed in an elastomer 52, such as vinyl. The weight of the layer 14 is defined by the density of the lead shot 50 in the layer 14. The layer 14 can be formed, for instance, by mixing the lead shot 50 into the elastomer 52 while it is in a liquid state, then pouring the mixture into a mold and allowing it to solidify. Additionally, by varying the density of lead shot 50 in the elastomer 52, different weights for the weighted layer 14 can be provided. By utilizing a skin 18 with a zipper 70, weighted layers 14 of different weights can be interchanged with the same skin 18 to provide a sleeve with a variety of different weights.

In the operation of the preferred embodiment, a user places his hand through the sleeve such that his thumb 16 fits through the hole 20 and the sleeve fits in a continuous manner across the palm and the back of the hand 12. The straps 26 are inserted through the loops 28 and then drawn taut so the sleeve 10 fits comfortably but securely on the hand 12. The first velcro portion 30 on each strap 26 is then pressed against the respective second velcro portion 32 disposed in proximity to the first side 22. The user then is able to perform essentially any exercise motion that he could otherwise do with his hands, but without the sleeve 10 thereon. The size and position of the volumes of weight 34 within the mold 36 allow the exercise sleeve 10 to flex and move with the joints of the hand in a natural manner.

The sleeve 10 by conforming to the hand develops very little moment during movement of the hand 12. Moreover, by being so comfortable, there is essentially no restriction of blood flow through the hand so that exercise can essentially can continue as long as the user desires without being limited by such factors as discomfort or cramping because of an improper fit of the sleeve 10 to the hand 12.

The exercise sleeve 10 enjoys some attributes which are more favorable to many exercisers than are conventional handweights either strapped or unstrapped. They are decidedly favorable to wrist-type weights also. Wrist weights tend to be either too light, too loose (and therefore mobile) or are made too tight so as to prevent movement. The exercise sleeve 10 is intended to serve as an aerobic driver for upper body movements either done separately or in combination with leg and trunk movements. The exercise sleeve 10 is ideal for walking, jogging and running; dance; shadowboxing or in-place calisthenics.

The exercise sleeve has the following attributes:

the radial artery at the wrist is accessible for pulse counting uses only half the hand (metacarpal area, between wrist and knuckles, the so-called metacarpal-phalangeal joints).

given its adjustable feature, two to three sizes will fit the range of human hand sizes a snug fit prevents skin chafing during high intensities of exercise Although the invention has been described in detail in the foregoing embodiments for the purpose of illustration, it is to be understood that such detail is solely for that purpose and that variations can be made therein by those skilled in the art without departing from the spirit and scope of the invention except as it may be described by the following claims.

I claim:

1. An exercise sleeve that fits on a hand comprising:

a flexible weighted layer that conforms with the hand in a continuous manner across the palm and the back of the hand and having a curved indentation which fits about the thumb; and a skin disposed about the weighted layer and which adjustably and removably conforms with the hand, said skin having a hole through which the thumb extends when the skin is on the hand.

2. An exercise sleeve that fits on a hand comprising:

a flexible weighted layer that conforms with the hand in a continuous manner across the palm and the back of the hand and having a curved indentation which fits about the thumb; and a skin disposed about the weighted layer and which adjustable and removably conforms with the hand, said skin having a hole through which the thumb extends when the skin is on the hand, said skin having a cavity within which the weighted layer is disposed and a sealable opening for providing access to the cavity so that the weighted layer can be removed from the skin.

3. An apparatus as described in claim 1 wherein the skin has means for adjustably and removably fastening the skin to the hand.

4. An apparatus as described in claim 1 wherein the skin has a first side and a second side, and the fastening means includes at least one strap extending from the first side, and at least one loop extending from the second side, said second side opposing said first side when the skin is on the hand such that the strap can be inserted through the loop and pulled to adjust the fit of the skin on the hand.

5. An apparatus as described in claim 4 wherein the strap has a first portion, and the skin has a second portion disposed in proximity to the first side such that the first portion can mate with the second portion and hold the strap when the strap is inserted through the loop.

6. An apparatus as described in claim 5 wherein the weighted layer is comprised of localized volumes of weight that are disposed and fixed in a mold made of a flexible material.

7. An apparatus as described in claim 6 wherein the volumes of weight are flexibly connected together.

8. An apparatus as described in claim 7 wherein the volumes of weight are made of lead and the material is an elastomer.

9. An apparatus as described in claim 8 wherein the elastomer is vinyl.

10. An apparatus as described in claim 6 wherein the volumes of weight are made of lead and the material is an elastomer.

11. An apparatus as described in claim 10 wherein the volumes of weight are lead shot.

12. An apparatus as described in claim 6 wherein the volumes of weight are sized and positioned in the mold such that the hand can flex naturally.

13. An exercise sleeve as described in claim 2 wherein the sealable opening of the skin includes a zipper for closing and opening said opening.

14. An exercise sleeve as described in claim 13 wherein said weighted layer having channels for providing enhanced flexibility.

* * * * *